US005454180A

United States Patent [19]

Volpe

[11] Patent Number: 5,454,180

[45] Date of Patent: Oct. 3, 1995

[54] PRE-ASSEMBLED SELF ERECTING DISPLAY

[76] Inventor: James R. Volpe, 247-B Miller Ave., Mill Valley, Calif. 94941

[21] Appl. No.: 24,184

[22] Filed: Feb. 26, 1993

[51] Int. Cl.[6] ..... A47F 5/11; G09F 1/06

[52] U.S. Cl. ..... 40/539; 40/610

[58] Field of Search ..... 40/539, 610

[56] References Cited

U.S. PATENT DOCUMENTS

| | | | |
|---|---|---|---|
| Re. 32,668 | 5/1988 | Smith | 211/149 |
| 2,330,287 | 9/1943 | Horr | 40/539 |
| 2,343,741 | 3/1944 | Blechta | 40/539 |
| 2,601,374 | 6/1952 | Ditzler et al. | 40/539 X |
| 3,017,148 | 1/1962 | Wathen | 40/539 |
| 3,721,413 | 3/1973 | Robinson | 248/174 X |
| 3,727,874 | 4/1973 | Wuensch | 248/174 |
| 4,235,032 | 11/1980 | Robinson | 40/539 |
| 4,493,424 | 1/1985 | Smith | 211/149 |
| 4,619,426 | 10/1986 | Drueck, Jr. | 248/174 |
| 4,773,622 | 9/1988 | Herlin | 248/174 |
| 4,854,060 | 8/1989 | Corbo et al. | 40/152.1 |

FOREIGN PATENT DOCUMENTS

| | | | |
|---|---|---|---|
| 350798 | 6/1931 | United Kingdom | 40/539 X |

*Primary Examiner*—Edward K. Look
*Assistant Examiner*—Michael S. Lee

[57] ABSTRACT

A pre-assembled self-erecting display of corrugated paper or the like includes a rear display panel, a front display panel and an easel member which is fastened in part to the back side of the rear display panel. Resilient members such as rubber bands are connected across a vertical fold of the easel member. This causes a wing panel of the easel member to fold rearward for support means and an edge of the rear display panel to fold forward to create a concave configuration. Hinged panels folding out of the easel member urge an inner portion of the rear display panel away from the easel member, thus causing the rear display panel to obtain a convex configuration. The other edge of the rear display panel is attached to a part of a second wing panel of the easel member, inversely causing it to unfold rearward, also for support means. A part of the easel member passes through a slot in the rear display panel and is fastened to the back side of the front display panel, thus causing a multiple level configuration. Included are one or more horizontal folds permitting the entire display to be folded over to reduce its size for shipping.

24 Claims, 5 Drawing Sheets

FIG. 5
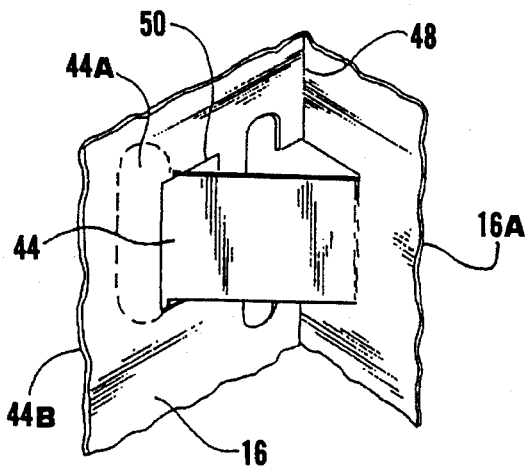
FIG. 8
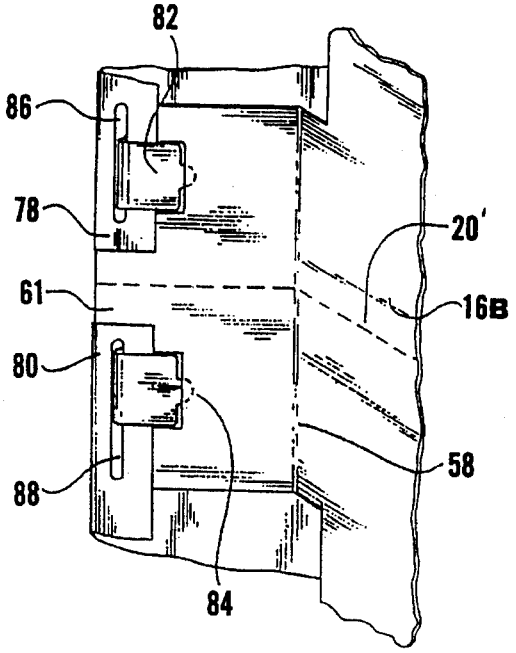
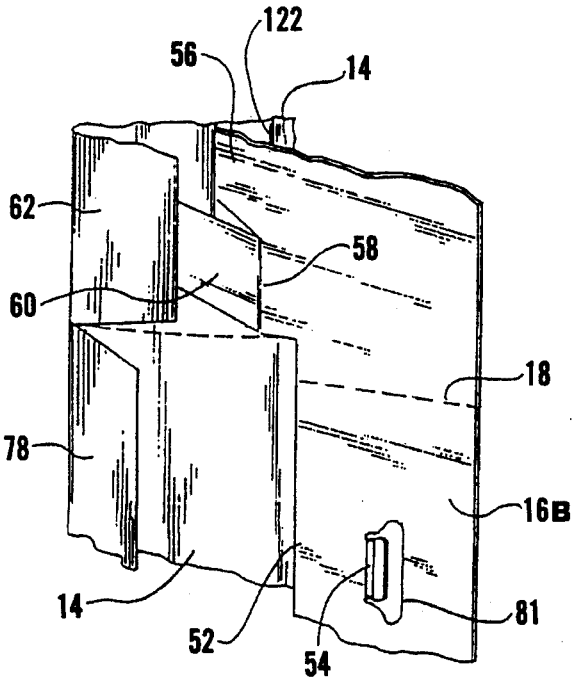
FIG. 7
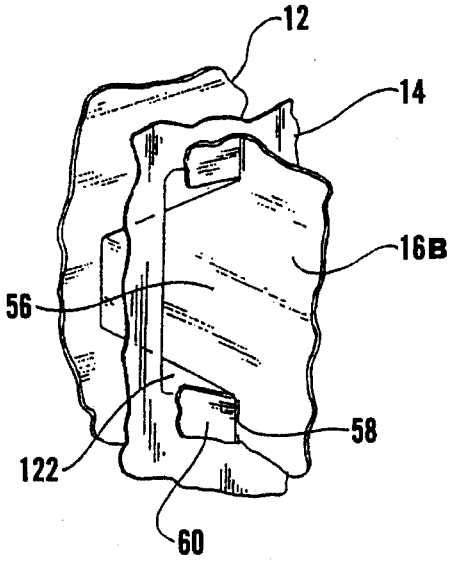
FIG. 9

FIG.11
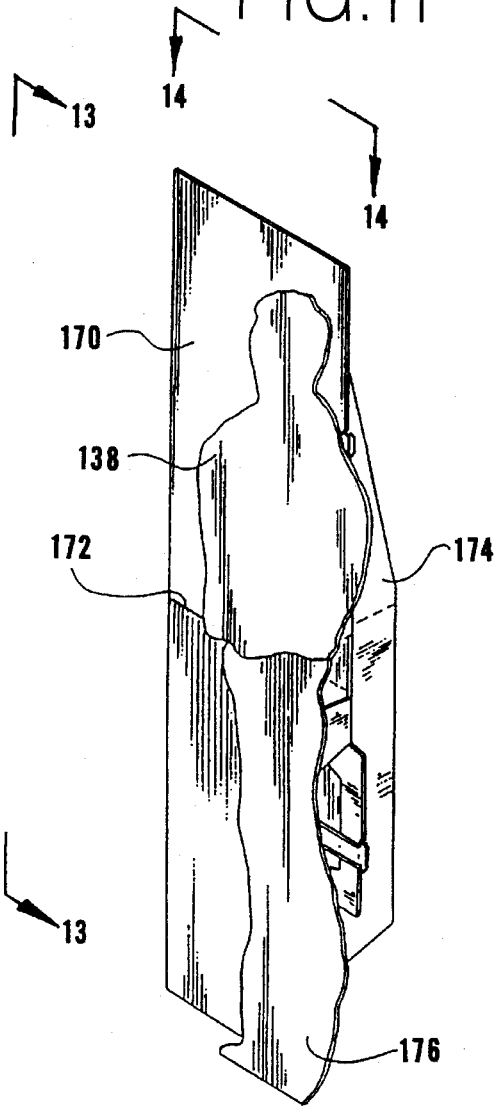
FIG.13
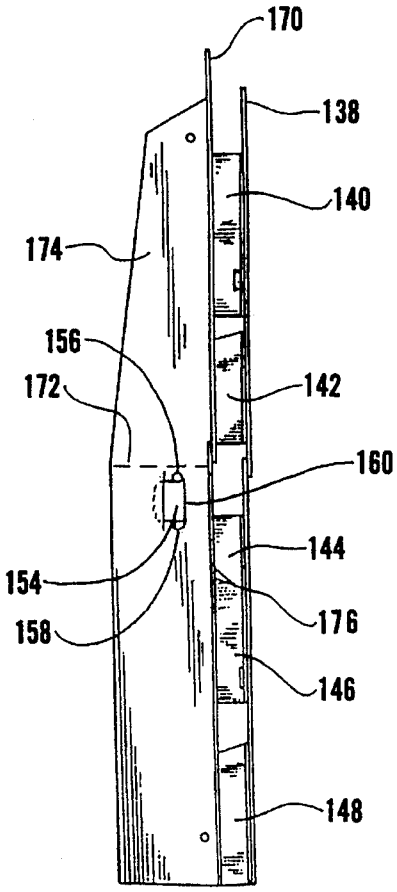
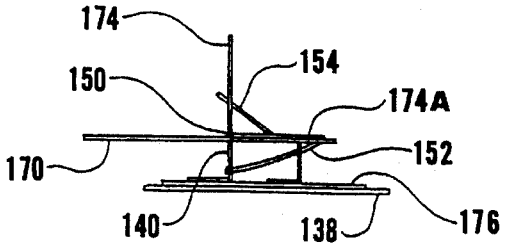
FIG.14
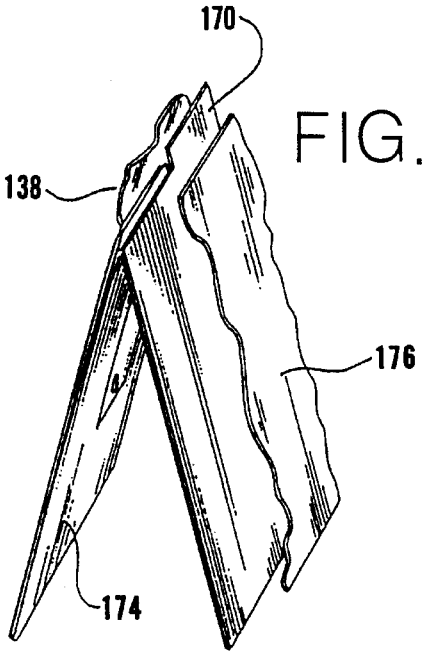
FIG.12

PRE-ASSEMBLED SELF ERECTING DISPLAY

BACKGROUND OF THE INVENTION

This invention relates generally to promotional displays sometimes referred to as standees for advertising of movies, videos, events, products and services, and more particularly to an easy and quick, pre-assembled self-erecting display of corrugated fiberboard and solid paperboard or like materials.

A common use of display signs is to advertise a new product or service for entertainment throughout the country. A good example is a new release of movies or movies on video cassette where it is desired to have a striking display to catch the attention of the movie goer or movie renter. It has been found that the most effective set displays are those which have life size figures or if not depicting individual figures, having a floor standing display which reaches the eye level of an adult. The typical dimensions would be 30 inches (76.2 cm) in width and 6 feet (183 cm) in height. One of the difficulties of such a size display is that it exceeds the maximum dimensions allowed by most common carriers providing quick and economical service. A common restriction is that of having a combined girth and length of 84 inches (213.4 cm). A typical display of 30 inches (76.2 cm) by 72 inches (183 cm) greatly exceeds that limit. The net result has been that such life size displays need to be folded lengthwise for shipment.

We have found that it is not only important that a display be of sufficient size and foldable for transport, but that it be automatically erectable when it is removed from the shipping carton and not include any separate pieces which might be lost. A further requirement is that such displays be erected by untrained persons without the benefit of instructions.

Previously, there has been some use of elastic bands in these type of displays in an attempt to create an easier and more rapid assembly process. This use has been limited to just folding of the easel wings and little or no attempt to incorporate other aspects of the display design, particularly multiple levels or curved dimensional surfaces. In most of these cases the display would simply be a single flat display panel with the easel piece previously glued to the back. A variety of perimeter contours and slight dimension effects have been attempted with limited success in achieving interesting and appealing designs. To create a greater dimensional look, additional panels would usually be shipped along and have to be attached at the retail store, which is undesirable as mentioned earlier.

Knockdown folding scores on the display panel and easel, necessary to collapse the display for shipment, must be in an aligned position and can create binding and fracturing at these points. This creates a damaged line across the face of the display panel and is very undesirable for the advertiser as well as for the retailer. Thinner material such as paperboard have been used to help alleviate the stress imposed on these knockdown scores, but without being braced by a curve or fold, these flat panels are weak, tending to warp, false crease, or dog-ear.

In addition, these previous displays have been very limited in size, both in width and in height. This is largely due to the need of fewer knockdown folding scores to minimize the distractive effect of the fractured fold lines. The larger the overall display panel, the more knockdown folding scores necessary to collapse the display down to a size, which is standard in the shipping of these types of displays.

A type of self-erecting display device is shown in the Herlin U.S. Pat. No. 4,773,622. In this case, a stand-up panel is erected by being pinched between adjacent side walls of a hexagonal structure, which pops open with the help of an elastic device. This system relies on the rigidity of an unbraced stand-up panel and a somewhat bulky base structure. This works well for a counter top display, but would substantially limit the size of a floor standing unit. Such a unit would take an excessive amount of floor area, require excessive material, and still have a floppy (unbraced) display panel.

In the Smith U.S. Pat. Nos. 4,493,424 and Re. 32,668, are disclosed display stands which are intended to contain product and open from a collapsed position. The back panel incorporates an upper display panel area, but it relies on the side panels for support and is substantially unbraced at its upper portions. An elastic element is used to open up the structure, but the box-type structure is limited in its adaptability. Also, these prior configurations do not have the ability to adapt to irregular graphic shapes or include multiple contoured panels needed to create an image having a substantial visual impact.

Accordingly, several objects and advantages of the invention are:

(a) to provide a one-piece display which will insure a complete and correctly assembled unit;

(b) to provide an easy, self-erecting display which sets up quickly (1 or 2 seconds);

(c) to provide a display which can have several contoured panels in a multitude of levels;

(d) to provide a self-erecting display which has single or compound curved surfaces for the main display panel;

(e) to provide a self-erecting display which is full sized (maximum video promotion format);

(f) to provide a display which has a knockdown folding score arrangement that allows for unfractured fold lines;

(g) to provide a self-erecting display which has a structurally sophisticated and interesting design to attract attention at the retail store;

(h) to provide a display which does not warp, false crease, or dog-ear under normal conditions;

(i) to provide an easel backed display which can have an irregular perimeter shape without affecting structure;

(j) to provide an easel backed display which minimizes consumption of valuable floor area in the retail store.

Further objects and advantages of the invention will become apparent from a consideration of the drawings and ensuing description.

SUMMARY OF THE INVENTION

The pre-assembled display device of the present invention is of corrugated paper or the like and is foldable for transport to a size acceptable to most parcel carriers and is capable of quick and easy erection by relatively untrained personnel upon removal from a shipping carton. One embodiment of the invention includes a rear display panel and a front display panel, both printed with graphic images and an easel member which is fastened in part to the back side of the rear display panel. An edge of the rear display panel is attached to hinged panels of the easel member. Resilient members such as rubber bands are connected across a vertical fold of the easel member. This causes a wing panel of the easel member to fold rearward for support means and is limited at approximately ninety degrees by a stop panel. This motion will simultaneously force the hinged panel and the edge of the rear display panel forward to create a concave configuration. The rear display panel has a slot therein through which another part of the wing panel passes and is fastened to the back side of the front display panel and pushes the front display panel forwardly away from the rear display panel.

Additional hinged panels from the easel member urged by resilient means another portion of the rear display panel away from the easel member, thus causing a portion of the rear display panel to also assume a convex configuration. The other vertical edge of the rear display panel is attached to a forwardly projecting part of a reverse folded second swing panel of the easel member, inversely causing this second wing panel to unfold rearward also for support means. This motion is limited by a cut out panel connected across the vertical fold of the second wing panel.

A second embodiment also includes a rear display panel, a front display panel and an easel member which is fastened in part to the back side of the rear display panel. The rear display panel has a slot therein through which a part of the easel member passes and is fastened to the back side of the front display panel. A wing panel of the easel member is folded back against the part of the easel member that is attached to the rear display panel. Resilient members are connected across a vertical fold of the easel member to a part of the rear display panel and the wing panel of the easel member. This causes the wing panel of the easel member to unfold rearward for support means and simultaneously causing the cut out panel of the easel member to push the front display panel forwardly away from the rear display panel. Both these embodiments include one or more horizontal folds permitting the entire display to be folded over to reduce its size for shipping.

BRIEF DESCRIPTION OF THE DRAWINGS

FIG. 5 is a fragmentary perspective drawing of a fold stop panel forming a part of the device of FIG. 1;

FIG. 7 is a fragmentary perspective drawing showing details of an interconnection forming part of the embodiment of FIG. 1.

FIG. 8 is a fragmentary perspective view of another interconnection forming part of the embodiment of FIG. 1; and FIG. 9 is a fragmentary perspective view of an additional interconnection arrangement used in the embodiment of FIG. 1.

FIG. 11 is a perspective view of another embodiment of the invention;

FIG. 12 is a perspective view of the device of FIG. 11 folded for packing;

FIG. 13 is a view from one end of the device of FIG. 11 taken along line 13—13 of FIG. 11;

FIG. 14 is a top view of the device of FIG. 11 taken along line 14—14 of FIG. 11.

DETAILED DESCRIPTION OF THE PREFERRED EMBODIMENTS

Figure 1:
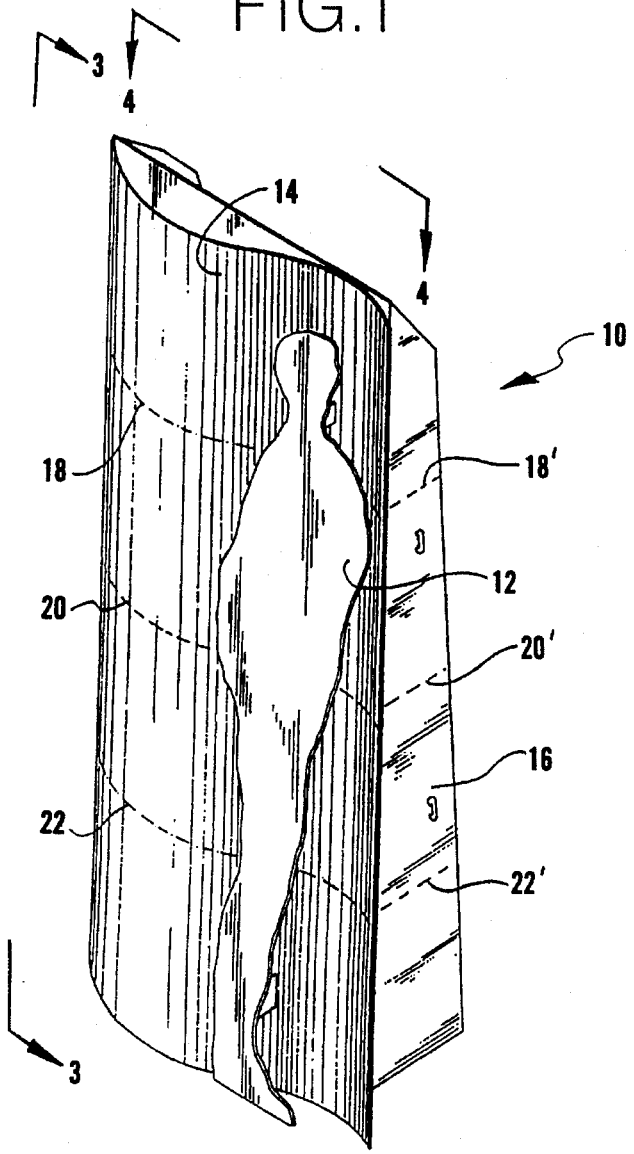
FIG. 1 is a perspective view of one embodiment of the invention.
Figure 2:
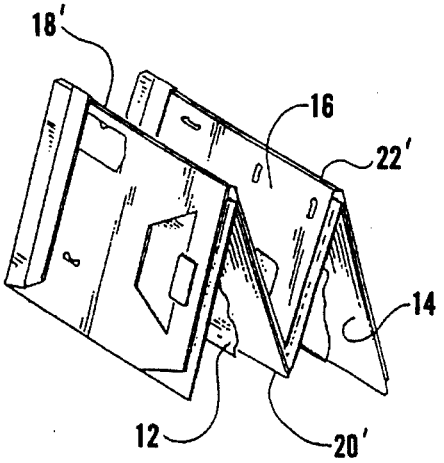
FIG. 2 is a perspective view of the device of FIG. 1 folded in readiness for packing.

Referring now to FIG. 1, a display device 10 is shown in erected form including a front display panel 12 which in this case is a human figure, a rear display panel 14 and an easel member 16. All of these parts may be of a planar material such as corrugated paper or the like. In the specific case of FIG. 1, the rear display panel 14 is of a paperboard material. Display device 10 which when erected is approximately six feet high, is designed such that it can first be folded flat and second, be folded into four separate panels at fold lines 18, 20 and 22. As is apparent from the drawing, the front display panel is displaced forwardly of the rear display panel, forward being toward the direction from which the graphic image is viewed and opposite the rearwardly projecting easel member 16. The rear display panel 14 is forced into a curved configuration, and the easel member 16 folds toward the rear to provide support for the display device 10. When it is desired to pack and ship the device 10, it is first folded such that it is essentially flat and is then folded along lines 18, 20 and 22 of rear display panel 14, lines 18', 20' and 22' of easel member 16 and corresponding fold lines of front display panel 12 to a configuration essentially like that shown in FIG. 2. It is apparent from FIG. 2 that the device 10 may from the position shown be pushed together such that it essentially consists of multiple layers of corrugated paper and paperboard for packing in a flat box. It will be clear that the layers on the outside (fold lines 18', 20' and 22') must be formed with parallel creases or otherwise relieved to permit the device 10 to fold flat.

Figure 3:
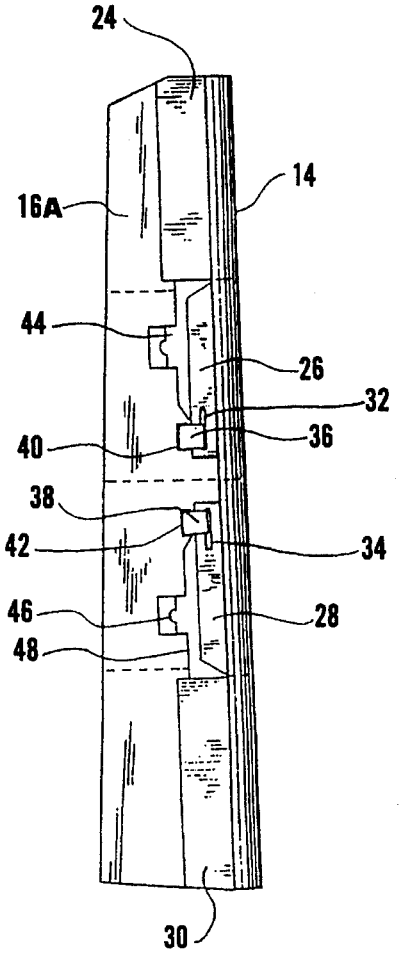
FIG. 3 is a view from one end of the device of FIG. 1 as taken along line 3—3 of FIG. 1.

FIG. 3 is a view of the end of the device of FIG. 1 as taken along line 3—3. In this view the curved rear display panel 14 may be seen to include a plurality of foldover panels 24, 26, 28 and 30 which fold over and are secured to a wing panel 16A of the easel member 16. Panels 24 and 30 are preferably glued or cemented to wing panel 16A. Panels 26 and 28 include slots 32 and 34, respectively, through which are inserted tabs 36 and 38 cut out of wing panel 16A and which fold under slots 40 and 42 in wing panel 16A. Attachment of the foldover panels 26 and 28 of rear display panel 14 by means of the tabs 36 and 38 and the elongated slots 32 and 34 provides flexibility so that some relative movement of the tabs relative to the slots is available during folding of the display device 10.

Wing panel 16A also includes two additional cut out panels 44 and 46 which bridge across the fold line 48 between wing panel 16A and the remaining part of easel member 16 which includes openings into which cut out panels 44 and 46 are inserted. This detail is shown in FIG. 5 in which fragmentary parts of easel member 16 and wing panel 16A are shown. It can be seen that, prior to folding on fold line 48, cut out panel 44 was cut out including vertically extending projections 44A and 44B which, after folding at fold line 48 are inserted through an opening 50 in easel member 16 with projections 44A and 44B being extended to limit the angle at which wing panel 16A may be folded away from easel member 16. Cut out panel 46 is identical and is also inserted through an opening in easel member 16 to limit movement of wing panel 16A.

Figure 4:
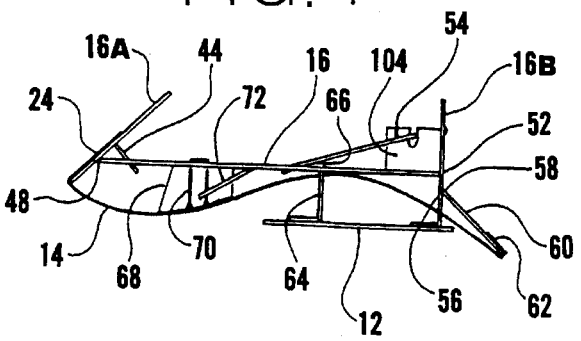
FIG. 4 is a top view of the device of FIG. 1 as taken along line 4—4 of FIG. 1.

FIG. 4 is a view from the top of the display device of FIG.

1 including front display panel 12, rear display panel 14, easel member 16, and wing panel 16A. Panel 24 is visible where it is attached to wing panel 16A and also cut out panel 44 which bridges across fold 48 and latches behind easel member 16.

Note that portions of wing panel 16A extend beyond fold 48 and that panel 24 does not fold over the end of easel member 16 at fold line 48 but folds over the end of the part of wing panel 16A which extends forward of fold line 48.

At its opposite end, easel member 16 has a fold line 52 with a major portion of a wing panel 16B extending essentially perpendicular to the remainder of easel member 16 such that it acts as a support for the display device 10. Wing panel 16B is pulled into a perpendicular position by means of a pair of rubber bands, one of which is shown at numeral 54, and both of which are anchored at points on wing panel 16B outwardly of fold line 52 and at points on easel member 16 considerably toward its center from fold line 52. A stop panel 104 includes a notch through which rubber band 54 passes, holding panel 104 perpendicular to wing panel 16B and preventing wing panel 16B from being pulled beyond the desired position by rubber band 54.

Extending on the opposite side of fold 52 are cut-out panels from wing panel 16B including a member 56 which extends through a slot in rear display panel 14 and is attached to the front display panel 12. Also extending from wing panel 16B and angled from a second fold line 58 are a number of extensions, one of which panel 60 is shown attached to a fold over panel 62 on the right hand edge of rear display panel 14. Other such extensions attached to portions of rear display panel 14 are in vertical alignment with panel 60 and are discussed below.

Attached to the back of front display panel 12 is a foldable brace 64 of corrugated paper which passes through slots in rear display panel 14 and easel member 16 and is folded over and tucked under a flap 66 cut out of easel member 16. Another such brace is in vertical alignment with brace 64.

A cut out flap 68 from easel member 16 is folded outwardly by the force of a rubber band 70 to push against the back side of rear display panel 14 causing it to curve forward and an additional stop panel 72 folds over flap 68 and serves as a stop, preventing flap 68 from folding back against the surface of easel member 16 under the force of the rubber band 70. Two or more such combinations such as flap 68, rubber band 70, and stop panel 72 may be used as required. Before the display can be folded, any such flap 68 must be manually folded back into easel member 16 thereby releasing flap 72 to be pulled toward the plane of easel member 16 by rubber band 70.

At the time the display device 10 is folded for packing, the rearwardly extending portion of wing panel 16B is rotated clockwise around fold line 52, stretching rubber band 54 and causing front display panel 12 to be displaced to the left and flat against rear display panel 14. This causes fold line 58 to be rotated to the left and folding wing panel 16B directly against hinged panel 60 and other panels in vertical alignment with panel 60. At the same time wing panel 16A is rotated clockwise around fold line 48 which pulls rear display panel 14 flat against easel member 16. Rear display panel 14 is attached to easel member 16 at vertically aligned points located to achieve the desired curve.

Figure 6:
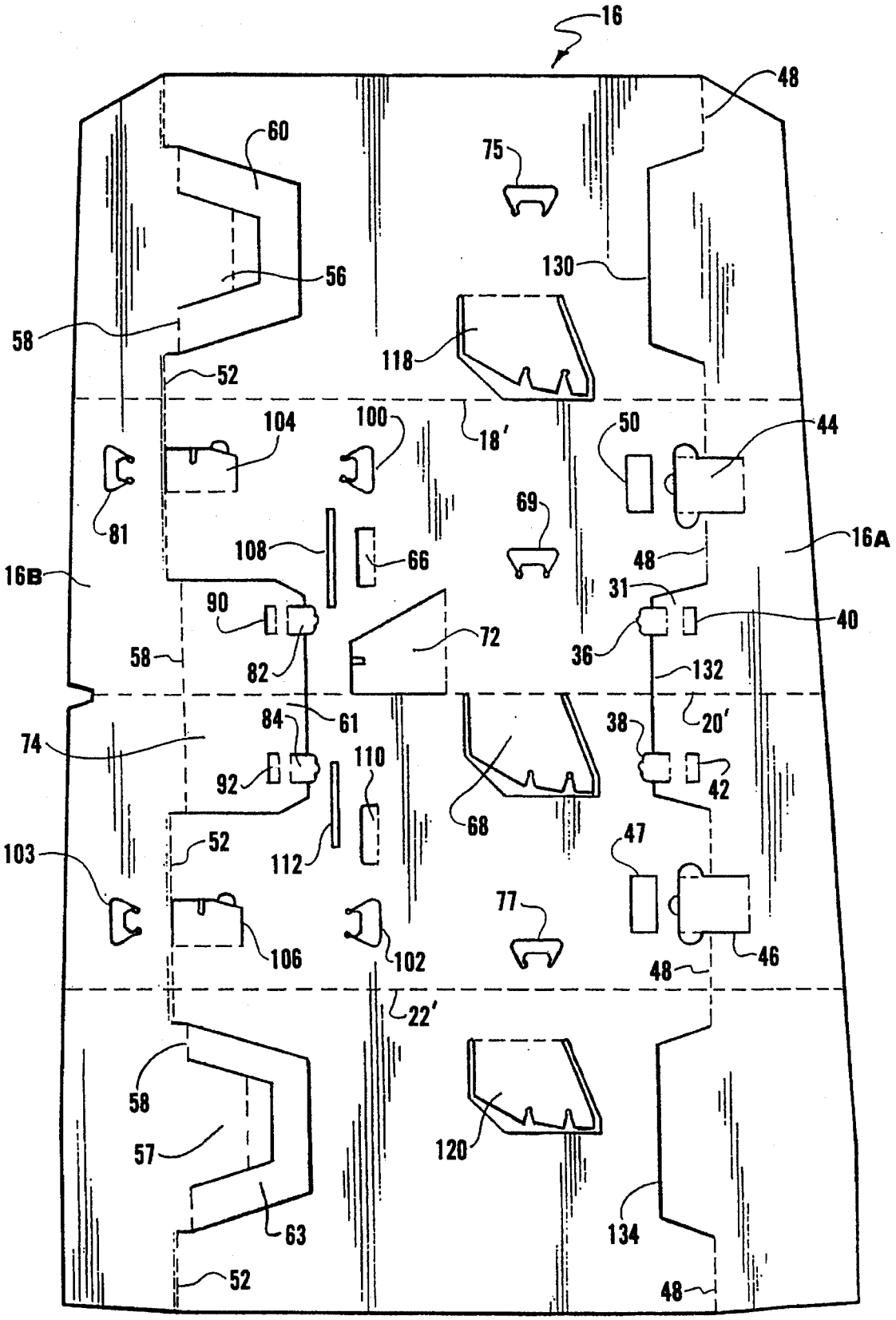
FIG. 6 is a plan view of the easel member of FIGS. 1–4 prior to folding.

FIG. 6 is a plan view of the easel member 16 of FIGS. 1–4 prior to folding. In this view internal lines shown as solid lines are cuts through the corrugated sheet and the dashed lines indicate fold lines. The major vertical fold lines 48 and 52 are shown which separate wing panels 16A and 16B respectively from the main part of easel member 16. Cut lines 130, 132 and 134 define a series of cut-out panels which extend forwardly of easel members 16 when wing panel 16A is folded toward the back as shown in FIG. 4. Hinged panels 60, 61 and 63 as well as cut out panels 56 and 57 which are inside the periphery of panels 60 and 63, respectively, all fold forward as wing panel 16B folds around fold line 52 ninety degrees to the rear. Cut out panels 56 and 57 extend forwardly as shown in FIG. 4 and are folded at the end as shown with the end portion glued or cemented to the back of front panel 12. Panels 60, 61 and 63 are again folded on fold line 58 such that they are angled approximately forty-five degrees from forward as shown on FIG. 4.

Cut out flap 68 is folded forwardly on line 20' and panel 72 is folded forwardly across flap 68 such as to prevent flap 68 from moving past a position essentially perpendicular to easel member 16. A rubber band 70, not shown in this view, extends between notches in flap 68 and an anchor 69. Flap 68 extends forwardly and urges rear display panel 14 into the curved contour shown in FIGS. 1, 3 and 4. Similar forwardly extending cut out flaps 118 and 120 may be used in the same way as flap 68 if it appears that more is required to cause rear display panel 14 to assume the desired contour. Anchors 75 and 77 provide means for attachment of additional rubber bands between the notches on flaps 118 and 120 and anchors 75 and 77, respectively. Additional flaps like panel 72 can be cut out to provide the corresponding function for flaps 118 and 120 as panel 72 provides for flap 68, if needed.

An anchor 81 in wing panel 16B cooperates with an anchor 100 in the surface of easel member 16 to locate a rubber band which also passes through a notch in panel 104 to hold panel 104 folded downwardly (to the rear). A similar pair of anchors 102 and 103 support another rubber band extending across panel 106. Panels 104 and 106 which are adjacent fold 52 prevent wing panel 16A from being pulled past the desired position essentially perpendicular to the plane of easel member 16, as shown in FIG. 4.

Positioned just below anchor 100 is a small cut out flap 66 which cooperates with an adjacent slot 108 to receive the foldable brace 64 attached to the back of front display panel 12. Brace 64 passes through a slot in member 14, slot 108 and folds under flap 66. Just above anchor 102 is another small flap 110 cooperating with an adjacent slot 112 to receive another foldable brace attached to the back of front display panel 12.

FIGS. 7, 8 and 9 are fragmentary perspective views of certain details of the structure of FIGS. 1–6. FIG. 7 shows a portion of wing panel 16B including horizontal fold line 18 and vertical fold lines 52 and 58. A part of hinged panel 60 extends forwardly and is angled beyond fold line 58 and is fastened to fold over panel 62. A member 56 of wing panel 16B which is in the same plane as the rearwardly extending part of wing panel 16B is shown extending through a slot 122 in rear display panel 14. Also shown in FIG. 7 is anchor 81 to which rubber band 54 is anchored and a portion of fold over panel 78.

FIG. 8 is a fragmentary perspective views of a portion of the display device 10 including part of wing panel 16B, hinged panel 74 and portions of fold over panels 78 and 80, which are secured to hinged panel 74 by inserting cut out flaps 82 and 84 through slots 86 and 88 respectively. Also shown are horizontal fold line 20' and vertical fold line 58.

FIG. 9 is a fragmentary perspective view of a portion of the display device 10 including parts of rear display panel 14, front display panel 12, wing panel 16B and member 56 which passes through a slot 122 in rear display panel 14 and is secured to the back of front display panel 12. Fold line 58 is shown with parts of extension 60.

Figure 10:
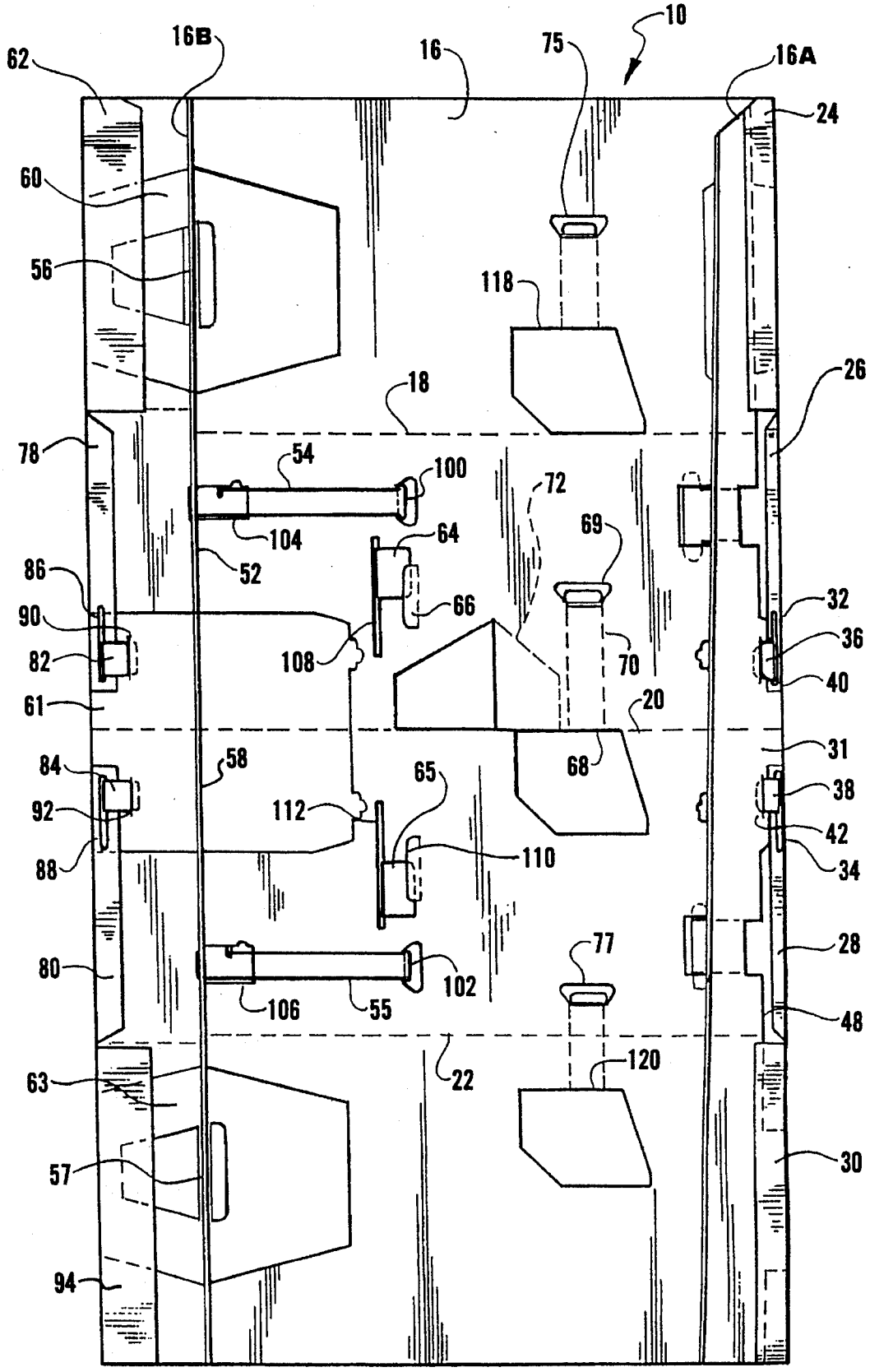
FIG. 10 is a rear plan view of the device of FIG. 1.

FIG. 10 is a rear plan view of the display device 10. Most of what is seen consists of easel member 16 including wing panels 16A and 16B including several cut out portions of each. At the top of wing panel 16A is panel 24 which is fastened to wing panel 16A. Below panel 24 is a second, somewhat narrower panel 26 secured to wing panel 16A by means of cut out flap 36 which enters a slot 32 and is folded over and tucked under a slot 40. A similar panel 28 is secured to wing panel 16A using a similar cut out flap 38 which passes through slot 34 and is folded over and tucked under slot 42. Panel 30 is fastened to wing panel 16A in the same manner as is panel 24. Fold line 48 being inbound or to the left of the outer edge of panels 24 and 30, forward extensions of wing panel 16A support panels 24 and 30 and an extension 31 supports panels 26 and 28.

In this view, one sees only the edge of the portion of wing panel 16B which extends to the rear. Also fold lines 52 and 58 are in alignment with member 56 which attaches to front display panel 12. A similar member 57 is also in alignment with and is part of wing panel 16B and is attached to front display panel 12 near the bottom. From fold line 58 and directed forwardly at an angle are hinged panel 60 to which fold over panel 62 is attached and vertically aligned panels 61 and 63. Fold over panels 78 and 80 are attached to panel 61 by means of cut out flaps 82 and 84 which enter slots 86 and 88, respectively and are tucked under slots 90 and 92 in the same manner as described with respect to cut out flaps 36 and 38. Panel 94 is fastened (cemented) to extension 63.

Wing panel 16B includes two small cut out anchors 81 and 103 (see FIG. 6) which serve to anchor one part of each of rubber bands 54 and 55. The opposite ends of rubber bands 54 and 55 are anchored on easel member 16 at anchors 100 and 102 respectively. Adjacent wing panel 16B are panels 104 and 106 which are notched to receive rubber bands 54 and 55 which thereby hold panels 104 and 106 perpendicular to wing panel 16B and thereby prevent wing panel 16B from being pulled past the desired position.

An end of brace 64 from front display panel 12 passes through a slot 108 and is tucked under cut out flap 66 of easel member 16. A second such brace 65 from front display panel 12 passes through a similar slot 112 and is tucked under a cut out flap 110.

Cut out flap 68 is hinged on fold line 20 and includes notches to receive one end of a rubber band 70 as shown on FIG. 6. Flap 68 is restrained from moving above fold line 20 by means of stop panel 72 which is hinged such that it swings over the top of cut out flap 68 and restrains it from being pulled further upward by rubber band 70 which is anchored on easel member 16 by means of anchor 69. Additional cut out flaps 118 and 120 with accompanying rubber bands are located in vertical alignment with flap 68. Applicant has found that one stop flap 72 is adequate to keep flaps 68, 118 and 120 from collapsing under the tension caused by flexing of rear display panel 14.

FIG. 11 is a perspective view of a second embodiment of my invention which also provides a display having three dimensional characteristics and which, although it can be made six feet tall or more, is foldable to be placed into a carton having a major dimensions only slightly greater than half the height of the erected display. In this embodiment, a rear display panel 170 contains on its front surface, desired display material and is foldable at a fold line 172. Located behind rear display panel 170 is an easel member 174 which is, in part, cemented or otherwise secured to the back of rear display panel 170. A front display panel consists of a lower part 176 and an overlapping upper part 138, each of which is fastened to a part of easel member 174.

FIG. 12 is a view of the display device of FIG. 10 partially folded for packing. In this view it will be apparent that the front display panel parts 176 and 138 are separated when rear display panel 170 and easel member 174 are folded together. When these members are pushed together they make a flat assembly having essentially the thickness of several layers of corrugated paper, which is easily placed in a carton for shipping or storage.

FIG. 13 is a view from the left side of the display device of FIG. 10 and shows rear display panel 170, upper part 138 and lower part 176 of the front display panel and the easel member 174. Visible in this view are a number of forwardly extending parts 140, 142, 144, 146 and 148 of easel member 174. Parts 140 and 142 are fastened to upper part 138 and parts 144,146 and 148 are fastened to the lower part 176 of the front display panel. A dashed line indicates fold line 172 of easel member 174 which is at essentially the same location as on rear display panel 170.

FIG. 14 is a view from the top of the display device of FIG. 10 and shows, among other things, edge views of rear display panel 170, upper part 138 and lower part 176 of the front display panel, and easel member 174 which includes a vertical fold line 150 for its entire height including a panel 174A which is fastened to the back of rear display panel 170. Various parts of easel member 174 are formed of cut outs and folded extensions which are fastened to front display panel parts 176 and 138. Extensions of easel member 174 which extend through slots in rear display panel 170 include fold parts 140 and 146, of which part 140 is visible, part 146 being directly below it. Additional foldover extensions 142, 144 and 148 are attached to the front display panel parts; extension 142 being attached to the upper panel 138 and extensions 144 and 148 being attached to lower panel 176.

A rubber band 152 extends between anchors on fold part 140 adjacent upper front display panel member 138 and a non folded extension of easel panel 174A. Also extending from easel panel 174A is a cut out panel 154 which has upper and lower extending projections 156, 158 (see FIG. 13) and which extends through a slot 160 in easel member 174. Thus cut out 154 serves to limit the rotation of member 174 such that it is not pulled past the desired position essentially perpendicular to front display panels 176 and 138 and is essentially like that shown in FIG. 5. A similar rubber band and anchors therefore may extend between fold part 146 and another non-folded extension of easel panel 174A.

When it is desired to fold the embodiment of FIGS. 11–14 for shipping, easel part 174 is rotated clockwise (as seen in FIG. 14) against panel 174A stretching rubber band 154 and causing members 176 and 138 to fold back against rear display panel 170. Rear display panel 170 and each part of member 174 then fold over on line 172, assuming the configuration shown in FIG. 12.

Accordingly, the reader will see that the one-piece, self-erecting display of this invention can be easily and quickly set up and provide an interesting design with irregular shapes and several dimensional levels. In addition, the display can be the full size of the promotional video standee standard without additional floor space and without fractured fold lines, warping, false creasing, or dog-eared corners.

While the above description contains many specificities, these should not be construed as limitations on the scope of the invention, but rather as an exemplification of some of the preferred embodiments of the invention. For example:

(a) the orientation of the curve of the rear display panel may be reversed;

(b) any display panel shown may be composed of two or more pieces taped or glued together as a solution to some printing or die cutting machine limitations;

(c) the curved display panel may be a single curve having one of the types of easel mechanisms on both sides of the display, creating either a simple convex or concave curved panel;

(d) the rear display panel may be made of a rigid planar material in which angular configurations could would be achieved;

(e) the rear display panel may include areas in which the easel member is exposed and presenting a graphic image;

(f) additional panels of various shape can be positioned at different levels;

(g) any additional display panels may be composed of two or more separate pieces in order to eliminate fold lines;

(h) the display can be produced in smaller versions for use on counter tops or display shelving;

(i) additional raised panels (usually smaller), can be attached to the display by a thickness of foam tape or like device as to provide a popped out title card, photographic stills, graphic shapes, advertising copy, etc.

(j) horizontally oriented cut out flaps may be attached to the front display panel which automatically push it forward when the display is unfolded.

While only two embodiments have been shown and described herein, it will be recognized by those skilled in the art that many modifications are possible and I do not desire to be limited other than by the scope of the attached claims and their equivalents.

I claim:

1. A pre-assembled display, comprising an easel member made of a planar material including a rearward projecting wing panel for supporting said display, at least one display panel made of a flexible planar material for presenting a graphic image, attachment means to connect said easel member and display panel, said easel member further includes at least one hinged flap, and a folding means for extending said hinged flap forward whereby causing a portion of said display panel to deflect forward providing an essentially curved panel configuration.

2. A pre-assembled display comprising an easel member made of a planar material including a rearward projecting wing panel for supporting said display, at least one display panel made of a flexible planar material for presenting a graphic image, first attachment means to connect said easel member and display panel, at least one hinged flap, a folding means for extending said hinged flap forward causing a portion of said display panel to deflect forward providing an essentially curved panel configuration, said easel member and said display panel includes a plurality of adjacent horizontal folds dividing said display into a plurality of parts foldable for shipping, and second attachment means whereby parts of said display panels can slide in relation to said easel member so as to alleviate binding at said horizontal folds.

3. A pre-assembled display comprising an easel member made of a planar material including a rearward projecting wing panel for supporting said display, at least one display panel made of a flexible planar material for presenting a graphic image, attachment means to connect said easel member and display panel, at least one hinged flap, a folding means for extending said hinged flap forward, and a resilient means urging said hinged flap to a position substantially perpendicular to said display panel causing an inner portion of said display panel to deflect forward to obtain a convex-like configuration.

4. The pre-assembled display of claim 3 wherein said easel member is made of a corrugated fiberboard material.

5. The pre-assembled display of claim 3 further comprising a stop panel folding perpendicular to said hinged flap, and a slot in said stop panel, and said resilient means passes through said slot, causing said stop panel to move into a position whereby preventing said hinged flap from collapsing back against said easel member.

6. The pre-assembled display of claim 3 wherein said wing panel includes a forwardly projecting cut out panel and said attachment means connecting said cut out panel to said display panel causing said wing panel to unfold rearward when said display panel is deflected.

7. The pre-assembled display of claim 6 wherein said easel member further comprises a limiting means in combination with said wing panel to prevent said wing panel from unfolding beyond a predetermined angle.

8. The pre-assembled display of claim 7 wherein said wing panel is attached to said rear display panel along a vertical line of attachment and said limiting means includes a cut out panel hinged adjacent to said vertical line, said cut out panel including locking tab means at its outboard end, a slot position on the opposite side of said vertical line from said cut out panel, said cut out panel bridging across said vertical line and passing through said slot with said locking tabs means restricting said wing panel from unfolding beyond a predetermined angle.

9. A pre-assembled display comprising an easel member made of a planar material including a rearward projecting wing panel for supporting said display, at least one display panel made of a flexible planar material for presenting a graphic image, attachment means to connect said easel member and display panel, and said easel member further includes at least one hinged panel having a vertical fold, means attaching said hinged panel to a vertical edge of said display panel, and folding means causing said wing panel to fold rearward and said hinged panel to fold forward thereby pushing said vertical edge of said display panel forward to obtain a concave-like configuration.

10. The pre-assembled display of claim 9 wherein said folding means comprises of a resilient means urging said wing panel to a position substantially perpendicular to said display panel.

11. The pre-assembled display of claim 10 wherein said easel member further includes a limiting means in combination with said wing panel to prevent said wing panel from folding beyond a predetermined angle.

12. The pre-assembled display of claim 11 wherein said limiting means includes a cut out panel, said wing panel originating along a vertical line, and a slot in said cut out panel, said cut out panel being hinged perpendicular to said vertical line, and said resilient means passing through said slot in said cut out panel, thereby folding said cut out panel to a position to restrict said wing panel from folding beyond a predetermined angle.

13. A pre-assembled display comprising an easel member made of a planar material including a rearward projecting wing panel for supporting said display, at least one front display panel for presenting a graphic image, attachment means to connect said easel member and said front display panel, and said easel member further includes at least one forwardly projecting cut out panel, and said cut out panel being in contact with the back of said front display panel, and folding means for moving said front display panel forwardly away form easel member whereby providing a three dimensional characteristic when said display is erected.

14. The pre-assembled display of claim 13 wherein said folding means further comprises a resilient means urging said wing panel and said cut out panel to a position substantially perpendicular to said display panel when said display is erected.

15. The pre-assembled display of claim 14 wherein said easel member and said display panels are in part made of a corrugated fiberboard material.

16. The pre-assembled display of claim 14 wherein said easel member further includes a limiting means in combination with said wing panel to prevent said wing panel and said cut out panel from folding beyond a predetermined angle.

17. The pre-assembled display of claim 16 wherein said limiting means includes a cut out panel, said wing panel is attached to said rear display panel along a vertical line of attachment, and a slot in said cut out panel, said cut out panel being hinged perpendicular to said vertical line, and said resilient means passing through said slot in said cut out panel, thereby folding said cut out panel to a position to restrict said wing panel from folding beyond a predetermined angle.

18. A pre-assembled display of a planar material comprising a front display panel, a rear display panel having a slot therein, and an easel member fastened to said rear display panel, said easel member including a vertical fold dividing said easel member into a first part and a wing panel, said wing panel including a first cut out panel extending through said slot and fastened to the back of said front display panel, and resilient means urging said wing panel and said first cut out panel to a position substantially perpendicular to said first part of said easel member whereby said cut out panel is moved against the back of said front display panel to move said front display panel forwardly away from said rear display panel.

19. A pre-assembled display as claimed in claim 18 wherein said easel member includes a second vertical fold displaced from said first vertical fold and defining a second wing panel, said second wing panel including a second cut out panel secured to a vertical edge of said rear display panel, a cut out flap horizontally hinged from said first part of said easel member and second resilient means forcing said flap against said rear display panel and causing a movement of said vertical edge of said rear display to deflect forward and said second wing panel to unfold rearward.

20. A pre-assembled display device as claimed in claim 19 wherein said first part of said easel member and said first wing panel each include cut out anchor members displaced from said vertical fold and other resilient means tending to pull said wing panel toward said first part, and means limiting the movement of said wing panel to a position substantially perpendicular to said first part of said easel member.

21. A pre-assembled display device as claimed in claim 19 wherein said limiting means comprises a horizontally hinged cut out flap adjacent said vertical fold, said flap including a notch receiving said other resilient means to force said flap into a position substantially perpendicular to said first and second parts of said easel member.

22. A pre-assembled display devise as claimed in claim 18 wherein, said rear display panel and said easel member each include adjacent horizontal folds, dividing said display device into a plurality of parts foldable for storage or shipping.

23. A pre-assembled display device as claimed in claim 22 wherein said easel member includes a second cut out panel hinged from said easel member, a third cut out panel adjacent said second cut out panel and hinged perpendicularly to said second cut out panel, resilient means attached to the opposite end of said second cut out panel and to said easel member tending to pull said second cut out panel against the back of said rear display panel, said third cut out panel being movable to limit the rotation of said second cut out panel to a position substantially perpendicular to said easel member.

24. A pre-assembled display device as claimed in claim 18 wherein said rear display panel and said easel member have vertical slots in alignment with each other and said front display panel includes a vertically aligned member attached at its back side and extending through said slots and fastened to the back side of said easel member.

* * * * *